United States Patent [19]

Churchill

[11] Patent Number: 4,715,908

[45] Date of Patent: Dec. 29, 1987

[54] DUPLEX STAINLESS STEEL PRODUCT WITH IMPROVED MECHANICAL PROPERTIES

[75] Inventor: Robin K. Churchill, Aloha, Oreg.

[73] Assignee: ESCO Corporation, Portland, Oreg.

[21] Appl. No.: 864,333

[22] Filed: May 19, 1986

Related U.S. Application Data

[63] Continuation-in-part of Ser. No. 801,746, Nov. 26, 1985, abandoned.

[51] Int. Cl.[4] ..... C22C 38/44

[52] U.S. Cl. ..... 148/327; 420/52; 420/57

[58] Field of Search ..... 148/327, 136, 135, 12 E; 420/52, 57

[56] References Cited

U.S. PATENT DOCUMENTS

| | | | |
|---|---|---|---|
| 4,055,448 | 10/1977 | Fujikura | 148/327 |
| 4,390,367 | 6/1983 | Niehaus et al. | 420/57 |
| 4,405,389 | 9/1983 | Larson | 148/327 |
| 4,500,351 | 2/1985 | Bond | 148/327 |

FOREIGN PATENT DOCUMENTS

| | | | |
|---|---|---|---|
| 55-158256 | 12/1980 | Japan | 148/327 |

*Primary Examiner*—L. Dewayne Rutledge
*Assistant Examiner*—Deborah Yee
*Attorney, Agent, or Firm*—Tilton, Fallon, Lungmus & Chestnut

[57] ABSTRACT

A method of making a duplex stainless steel is provided for an alloy having the following composition:

| | | | | |
|---|---|---|---|---|
| Carbon | 0.001 | to | 0.08 | Wt. % |
| Manganese | 0.001 | to | 2.00 | Wt. % |
| Silicon | 0.001 | to | 1.50 | Wt. % |
| Chromium | 20.00 | to | 27.50 | Wt. % |
| Nickel | 8.00 | to | 11.00 | Wt. % |
| Molybdenum | 3.00 | to | 4.50 | Wt. % |
| Sulfur | 0.0001 | to | 0.050 | Wt. % |
| Phosphorus | 0.0001 | to | 0.050 | Wt. % |
| Nitrogen | 0.10 | to | 0.30 | Wt. % |
| Iron | Balance | | | |

by selecting a heat treating temperature in the range of about 2050° F. to about 2350° F. to provide a desired impact toughness and a desired yield strength.

1 Claim, 9 Drawing Figures

EMPIRICALLY DERIVED RELATIONSHIP BETWEEN COMPOSITION, SOLUTION TREATMENT AND TEMPERATURE AND YIELD STRENGTH $$SY = 17.83\left(\frac{CREQ}{NIEQ}\right) - 100.18\left(\frac{CREQ}{NIEQ}\right) + \left[\left(\frac{CREQ}{NIEQ}\right) - 3.05\right]^{0.7} \times \left[\frac{T-2050}{1.85}\right]^{0.5} + 188.42$$

CREQ = 1.5 (%Cr+%Si+%Mo)

NIEQ = %Ni+0.3(%Mn)+%Cu+22(%C)+5(%N)

T = SOLUTION TREATMENT TEMPERATURE (DEGREES FAHRENHEIT)

TABLE I

THE EFFECTS OF COMPOSITION AND SOLUTION TREATMENT TEMPERATURE ON YIELD STRENGTH

| HEAT NUMBER | C | Mn | Si | Cr | Ni | Mo | Cu | N | CREQ/NIEQ RATIO | YIELD STRENGTH (KSI) 2050°F SOLUTION TREATMENT | | 2200°F SOLUTION TREATMENT | | 2350°F SOLUTION TREATMENT | |
|---|---|---|---|---|---|---|---|---|---|---|---|---|---|---|---|
| | | | | | | | | | | ACTUAL | PREDICTED | ACTUAL | PREDICTED | ACTUAL | PREDICTED |
| 69820 | 0.030 | 0.49 | 1.51 | 20.96 | 9.03 | 3.79 | 0.15 | 0.112 | 3.73 | 58.5 | 63.0 | — | 69.9 | 70.1 | 72.8 |
| 70329 | 0.057 | 0.47 | 1.06 | 20.74 | 9.63 | 2.86 | 0.13 | 0.166 | 3.09 | 47.8 | 49.1 | 47.3 | 50.0 | 47.3 | 50.3 |
| 70330 | 0.060 | 0.47 | 0.23 | 20.87 | 9.34 | 2.92 | 0.15 | 0.160 | 3.07 | 47.3 | 48.9 | 45.3 | 49.4 | 45.3 | 49.6 |
| 70331 | 0.055 | 0.52 | 0.87 | 26.00 | 8.68 | 2.91 | 0.13 | 0.225 | 3.95 | 68.3 | 71.0 | 75.1 | 79.4 | 80.5 | 82.9 |
| 70332 | 0.059 | 0.41 | 0.26 | 24.95 | 9.00 | 2.99 | 0.15 | 0.262 | 3.56 | 58.9 | 57.8 | 62.9 | 63.4 | 61.9 | 65.7 |
| 70333 | 0.051 | 0.55 | 1.13 | 20.91 | 9.06 | 2.74 | 0.13 | 0.077 | 3.42 | 51.4 | 54.4 | 52.8 | 58.9 | 55.2 | 60.8 |
| 70334 | 0.055 | 0.46 | 0.68 | 21.54 | 6.63 | 2.52 | 1.43 | 0.170 | 3.62 | 53.0 | 59.4 | — | 65.4 | 60.6 | 67.9 |
| 70335 | 0.040 | 0.50 | 1.42 | 21.43 | 8.55 | 3.72 | 0.13 | 0.134 | 3.84 | 58.4 | 66.6 | 70.5 | 74.3 | 73.9 | 77.4 |
| 70936 | 0.030 | 0.44 | 1.35 | 21.67 | 8.82 | 3.79 | 0.12 | 0.109 | 3.91 | — | 69.4 | 69.2 | 77.5 | — | 80.9 |
| 70937 | 0.051 | 0.42 | 0.69 | 24.62 | 8.97 | 3.02 | 0.12 | 0.195 | 3.76 | 67.7 | 63.7 | 69.8 | 70.8 | 75.3 | 73.7 |
| 71316 | 0.047 | 0.46 | 0.94 | 24.93 | 8.98 | 3.14 | 0.14 | 0.220 | 3.82 | — | 65.9 | 77.1 | 73.4 | — | 76.5 |
| 71545 | 0.052 | 0.44 | 1.20 | 20.88 | 9.05 | 3.83 | 0.18 | 0.126 | 3.49 | — | 56.0 | 67.8 | 61.0 | — | 63.1 |
| 72031 | 0.024 | 0.50 | 0.91 | 24.20 | 9.89 | 3.17 | 0.15 | 0.170 | 3.67 | 57.6 | 60.8 | 63.5 | 67.2 | 70.0 | 69.9 |
| 72497 | 0.039 | 0.54 | 1.05 | 24.59 | 9.83 | 3.51 | 0.11 | 0.198 | 3.66 | 68.0 | 60.5 | 67.9 | 66.8 | 76.8 | 69.5 |
| 72691 | 0.030 | 0.59 | 1.00 | 23.46 | 8.82 | 3.04 | 0.10 | 0.184 | 3.86 | — | 67.5 | 62.8 | 75.3 | — | 78.6 |
| 72847 | 0.055 | 0.45 | 1.17 | 23.31 | 9.04 | 3.36 | 0.11 | 0.166 | 3.69 | 63.6 | 61.5 | 71.4 | 68.0 | 75.4 | 70.8 |
| 73059 | 0.036 | 0.57 | 0.37 | 26.57 | 10.49 | 3.99 | 0.11 | 0.184 | 3.72 | 72.0 | 62.4 | 71.8 | 69.2 | 71.9 | 72.0 |
| 73112 | 0.060 | 0.63 | 1.17 | 21.33 | 9.81 | 3.07 | 0.15 | 0.056 | 3.26 | 54.9 | 51.4 | 55.8 | 54.5 | — | 55.7 |
| 73114 | 0.039 | 0.51 | 1.22 | 21.57 | 9.52 | 2.93 | 0.10 | 0.066 | 3.52 | 52.6 | 56.7 | — | 62.0 | — | 64.2 |
| 73342 | 0.050 | 0.87 | 1.38 | 21.17 | 9.32 | 2.97 | 0.28 | 0.079 | 3.37 | 54.0 | 53.3 | 56.1 | 57.4 | — | 59.1 |
| 73343 | 0.035 | 0.64 | 1.26 | 21.42 | 9.10 | 2.86 | 0.22 | 0.077 | 3.59 | 53.3 | 58.6 | — | 64.5 | — | 66.9 |
| 73523 | 0.031 | 0.57 | 1.03 | 24.73 | 9.70 | 3.36 | 0.23 | 0.249 | 3.63 | 66.3 | 59.8 | 68.2 | 65.9 | 69.4 | 68.5 |
| 73750 | 0.029 | 0.48 | 0.99 | 24.46 | 9.72 | 3.40 | 0.23 | 0.299 | 3.54 | — | 57.2 | 62.9 | 62.7 | 71.8 | 65.0 |

RELATIONSHIP BETWEEN CREQ:NIEQ RATIO, TEST TEMPERATURE AND IMPACT TOUGHNESS.

TABLE II

RELATIONSHIP BETWEEN CREQ:NIEQ RATIO AND IMPACT TOUGHNESS

| | CREQ/ NIEQ RATIO | CHARPY V-NOTCH IMPACT TOUGHNESS (FT.-LBS.) | | | | | | | | | | | |
|---|---|---|---|---|---|---|---|---|---|---|---|---|---|
| | | 2050 °F SOLUTION TREATMENT | | | | 2200 °F SOLUTION TREATMENT | | | | 2350 °F SOLUTION TREATMENT | | | |
| | | +72°F. | +28°F. | -50°F. | -100°F. | +72°F | +28°F. | -50°F | -100°F. | +72°F. | +28°F. | -50°F | -100°F. |
| 70330 | 3.07 | — | — | — | — | 136, 155 | — | — | 110, 128 | — | — | — | — |
| 70331 | 3.95 | 122, 130 | 118, 120 | 105, 111 | — | 129 | 130, 114 | 105, 102 | 38 | 135, 127 | 120, 118 | 104, 95 | — |
| 70333 | 3.42 | — | — | — | — | 182, 157 | — | — | 143, 132 | — | — | — | — |
| 70335 | 3.84 | — | — | — | — | — | 125, 121 | 120, 120 | 138 | 140, 142 | 142, 136 | 125, 114 | — |
| 70339 | 5.26 | 100, 101 | 108, 105 | 83, 83 | — | 112 | 111, 84 | 53, 48 | (38) | 75, 64 | 77, 50 | 40, 21 | — |
| 71316 | 3.82 | — | — | — | — | 129 | 135 | 93 | 46 | — | — | — | — |
| 71545 | 3.49 | — | — | — | — | 153, 163 | — | — | 108, 140 | — | — | — | — |
| 71563 | 4.88 | 120, 114 | 82, 76 | 70, 71 | 25, 29 | — | — | — | — | — | — | — | — |
| 72031 | 3.67 | 188, 150 | — | 138, 162 | 142, 148 | 132, 142 | — | — | 133, 109 | — | — | — | — |
| 72497 | 3.66 | — | — | — | — | 138, 125 | — | — | 102, 98 | — | — | — | — |
| 72847 | 3.69 | — | — | — | — | 133 | 130 | 110 | 102 | — | — | — | — |
| 73059 | 3.72 | — | — | — | — | 130, 108 | 130 | 120 | 110, 90 | — | — | — | — |
| 73523 | 3.63 | — | — | — | — | 209 | — | 158 | 157 | — | — | — | — |
| 73750 | 3.54 | — | — | — | — | 158, 150 | — | — | 111, 108 | — | — | — | — |

IMPACT TOUGHNESS OF INVENTIVE ALLOY AND OTHER HIGH STRENGTH DUPLEX STAINLESS STEELS

TABLE III

MECHANICAL PROPERTIES OF THE INVENTIVE ALLOY

| | | HEAT 70355* (CAST) | HEAT 71545* (CAST) | HEAT 72497* (CAST) | HEAT 72847* (CAST) | HEAT 71316+ (CAST) | HEAT 71316• (CAST) | HEAT 72031▲ (FORGED) |
|---|---|---|---|---|---|---|---|---|
| UTS (KSI) | | 106.8 | 109.2 | 105.6 | 109.6 | 109.3 | 102.8 | 108.0 |
| SY ((KSI) | | 70.5 | 67.8 | 67.9 | 71.4 | 68.5 | 65.3 | 72.0 |
| %E | | 35 | 35 | 35 | 40 | 35 | 35 | 42 |
| %R OF A | | 62 | 54 | 54 | 60 | 62 | 43 | 69 |
| HARDNESS (BHN) | | 223 | 207 | 217 | 223 | - | - | 217 |
| CV (FT:LBS) | +72°F | - | 153,163 | 138,125 | 133 | 129 | 89 | 214 |
| | +28°F | 121,125 | - | - | 130 | 135 | 82 | 166 |
| | −50°F | 120,120 | - | - | 110 | 93 | 53 | 149 |
| | −100°F | 138 | 108,140 | 102,98 | 102 | 46 | 30 | 152 |

*SPECIMENS TAKEN FROM STANDARD CAST KEEL BARS.

+SPECIMENS TAKEN FROM SURFACE OF 6 IN x 12 IN x 12 IN BLOCK.

•SPECIMENS TAKEN FROM CENTER OF 6 IN x 12 IN x 12 IN BLOCK.

▲SPECIMENS TAKEN FROM 1/4T OF 1 1/2 IN THICK MATERIAL.

HAZ IMPACT TOUGHNESS OF INVENTIVE ALLOY AND OTHER HIGH STRENGTH DUPLEX STAINLESS STEELS

TABLE IV

PREFERRED COMPOSITION RANGES OF THE INVENTIVE ALLOY

| | COMPOSITION "A" | COMPOSITION "B" | COMPOSITION "C" |
|---|---|---|---|
| CARBON | 0.07 MAX | 0.07 MAX | 0.07 MAX |
| MANGANESE | 2.00 MAX | 2.00 MAX | 2.00 MAX |
| SILICON | 1.50 MAX | 1.50 MAX | 1.50 MAX |
| CHROMIUM | 20.50–22.50 | 22.50–24.00 | 23.50–26.00 |
| NICKEL | 8.00–9.50 | 8.50–10.00 | 9.00–10.50 |
| MOLYBDENUM | 3.00–4.00 | 3.00–4.00 | 3.00–4.00 |
| NITROGEN | 0.10–0.25 | 0.15–0.25 | 0.15–0.25 |
| SULFUR | 0.025 MAX | 0.025 MAX | 0.025 MAX |
| PHOSPHORUS | 0.04 MAX | 0.04 MAX | 0.04 MAX |

PITTING RESISTANCE OF INVENTIVE ALLOY
AND OTHER HIGH STRENGTH DUPLEX STAINLESS STEELS
IN DE-AERATED 5% NaCl 0.01M HCl

DUPLEX STAINLESS STEEL PRODUCT WITH IMPROVED MECHANICAL PROPERTIES

This is a continuation-in-part of the co-pending application Ser. No. 801,746 filed Nov. 26, 1985, now abandoned.

BACKGROUND AND SUMMARY OF INVENTION

This invention relates to a method of making a high strength duplex stainless steel and a product of this alloy in either cast or wrought form. The material of this invention displays superior toughness, weldability and cracking resistance in $H_2S$ bearing environments compared to other duplex stainless steels of similar strength level.

In recent years, a considerable number of high strength austenitic/ferritic duplex stainless steels have been introduced, and the range of applications for these materials has expanded rapidly. The primary reason for this is that these alloys, as a class, offer an attractive combination of strength and corrosion resistance. Typically, these alloys exhibit yield strengths which are about twice those of "ordinary" stainless steels (when compared in the solution treated condition). In terms of general corrosion resistance, these alloys perform quite well in a wide variety of environments. They also have good resistance to localized corrosion and stress corrosion cracking in the presence of chlorides. In resisting these forms of corrosion, the performance of duplex stainless steels often rivals that of far more expensive, more highly-alloyed materials.

The high strength duplex stainless steels of the prior art, however, have had a number of drawbacks. Cast grades generally exhibited only moderate impact toughness at room temperature, and suffered marked losses in toughness as temperatures decreased. Duplex grades were also susceptible to serious embrittlement in the heat affected zones (HAZs) of welds. They also exhibited poor resistance to cracking in the sour ($H_2S$-bearing) environments often encountered in oil industry applications. These deficiencies have been major factors inhibiting even wider application of these materials.

Most high strength duplex stainless steels are designed to have a microstructure consisting of about 50% ferrite and 50% austenite. It is this microstructure which is responsible for the high strength and good corrosion resistance of these materials. In the duplex stainless steels of the prior art, the desired ferrite:austenite ratio was obtained only by controlling the composition. This prevented alloy designers from using other techniques for improving the toughness of the ferrite phase which would lead to improved toughness of the total alloy.

The current invention involves the realization that the ferrite-austenite ratio can be adjusted not only by varying the composition, but also by varying the solution treatment temperature.

By using this concept, it is possible to produce a high strength duplex stainless steel having excellent mechanical properties in both cast and wrought forms.

According to the invention a duplex stainless steel having the following composition

| | | | | |
|---|---|---|---|---|
| Carbon | 0.001 | to | 0.08 | Wt. % |
| Manganese | 0.001 | to | 2.00 | Wt. % |

-continued

| | | | | |
|---|---|---|---|---|
| Silicon | 0.001 | to | 1.50 | Wt. % |
| Chromium | 20.00 | to | 27.50 | Wt. % |
| Nickel | 8.00 | to | 11.00 | Wt. % |
| Molybdenum | 3.00 | to | 4.50 | Wt. % |
| Sulfur | 0.0001 | to | 0.050 | Wt. % |
| Phosphorus | 0.0001 | to | 0.050 | Wt. % |
| Nitrogen | 0.10 | to | 0.30 | Wt. % |
| Iron | Balance | | | |

is produced. The composition is balanced such that:

$$3.50 \leqq \left(\frac{\text{Creq}}{\text{Nieq}}\right) \leqq 4.00$$

where:

Creq≡1.5(% Cr+% Si+% Mo)

Nieq≡% Ni+0.3(% Mn)+% Cu+22(% C)+5% N

Products of this material are then solution treated by heating to a temperature in the range of 2050° F. to 2350° F. and then cooling rapidly as with a water quench. For cast products, the desired yield strength is developed by solution treating at a temperature selected according to the following approximate relationship:

$$Sy = 17.83\left(\frac{\text{Creq}}{\text{Nieq}}\right)^2 - 100.18\left(\frac{\text{Creq}}{\text{Nieq}}\right) + \left[\left(\frac{\text{Creq}}{\text{Nieq}}\right) - 3.05\right]^{0.7} + \left[\frac{T - 2050}{1.85}\right]^{0.5} - 188.42$$

where:

Sy=yield strength (0.2% offset) in KSI

Cr=chromium equivalent≡1.5(% Cr+% Si+% Mo)

Ni=nickel equivalent≡% Ni+0.3(% Mn)+% Cu+22(% C)+5(% N)

It should be noted that the composition ranges of U.S. Pat. No. 4,032,367 overlap those of the inventive alloy. Certain compositions of this material combined with certain solution treatment temperatures probably would give a good combination of strength and toughness. However, U.S. Pat. No. 4,032,367 does not recognize the relationships between Creq: Nieq ratio, solution treatment temperature and mechanical properties necessary to accomplish this. Obtaining a good combination of strength and toughness with the information given in U.S. Pat. No. 4,032,367 would simply be a matter of chance. Other patents such as U.S. Pat. Nos. 4,500,351 and 4,055,448 disclose preferred Creq:Nieq relationships, but they differ from those of this invention and are not directly tied to mechanical properties or heat treatment.

Compared to high strength duplex stainless steels of the prior art, the inventive material exhibits considerably greater impact toughness values, particularly at low temperatures. It also exhibits considerably greater impact toughness values in the HAZs of welds. Furthermore, the inventive material exhibits improved resistance to cracking when tested in a simulated sour gas environment according to NACE (National Association of Corrosion Engineers) Test Method TM-01-77.

The invention is described in conjunction with the accompanying FIGURES and TABLES:

FIG. 1 is a graph of the empirically derived relationship between composition, solution treatment and temperature and yield strength;

TABLE I is a tabulation of the effects of composition and solution treatment temperature on yield stength;

FIG. 2 is a graph of the relationship between Creq:-Nieq ratio, test temperature and impact toughness;

TABLE II is a tabulation of the relationship between Creq:Nieq ratio and impact toughness;

FIG. 3 includes 3 graphs of the impact toughness of inventive alloy and other high strength duplex stainless steels;

TABLE III is a tabulation of the mechanical properties of the inventive alloy;

TABLE IV is a tabulation of the preferred composition ranges of the inventive alloy; and FIG. 5 includes 4 graphs of the pitting resistance of inventive alloy and other high strength duplex stainless steels in de-aerated 5% NaCl+0.01M HCl.

DETAILED DESCRIPTION

Figure 1:
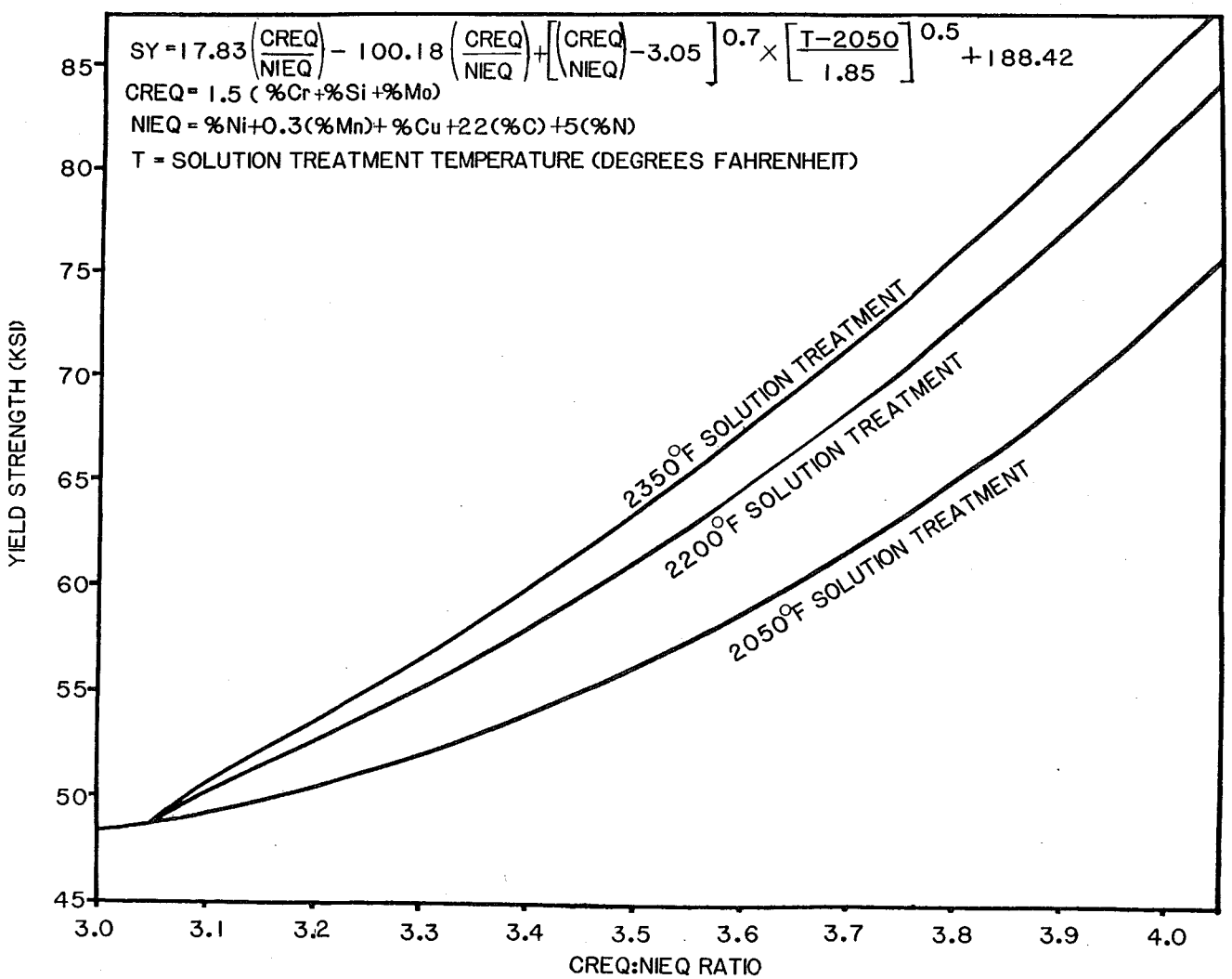

In cast high strength duplex stainless steels, mechanical property behavior, microstructure and composition are related in the following manner:

(1) Strength is primarily related to ferrite content. Higher ferrite contents lead to higher strength levels and lower ferrite contents lead to lower strength levels.

(2) In material which has been given an appropriate solution treatment, toughness (as reflected by transition temperature) is primarily controlled by the percentage of ferrite, its distribution and its inherent toughness.

(3) The ferrite content is controlled by the composition of the alloy and by the solution treatment temperature.

(4) The composition of the ferrite is controlled by the composition of the alloy and by the solution treatment temperature.

(5) The inherent toughness of ferrite is controlled by its composition. As with ferritic stainless steels, increasing the nickel content of the ferrite phase increases its inherent toughness.

In the prior art, it has been the practice to solution treat high strength duplex stainless steels at temperatures similar to those used for "ordinary" austenitic stainless steels (e.g. 2000° F. to 2050° F.). The desired strength levels have been obtained simply by adjusting the composition to achieve the necessary ferrite content. Because of this practice, it has been necessary to maintain relatively high ratios of ferrite forming elements (Cr, Si and Mo) to austenite forming elements (Ni, Cu, C and N). Consequently, the nickel levels of available high strength duplex stainless steels have been relatively low, generally in the range of 4% to 7%. This, in turn, has resulted in low nickel contents in the ferrite and ultimately in poor low temperature toughness in these materials.

This invention is based on the realization that the ferrite contents (strength levels) of high strength duplex stainless steels can be effectively varied not only by adjusting composition, but also by selective use of solution treatment temperature. By employing higher solution treatment temperatures than those which have been commonly used for high strength duplex stainless steels, it is possible to obtain the desired ferrite contents (strength levels) using alloy compositions with higher nickel contents for a given content of Cr+Mo+Si. This results in higher nickel contents in the ferrite. Consequently, improvements in low temperature toughness, the toughness of HAZs and resistance to sulfide stress cracking are realized.

In the practice of this invention, a heat of duplex stainless steel is produced to the following composition:

| | | | | |
|---|---|---|---|---|
| Carbon | 0.001 | to | 0.08 | Wt. % |
| Manganese | 0.001 | to | 2.00 | Wt. % |
| Silicon | 0.001 | to | 1.50 | Wt. % |
| Chromium | 20.00 | to | 27.50 | Wt. % |
| Nickel | 8.00 | to | 11.00 | Wt. % |
| Molybdenum | 3.00 | to | 4.50 | Wt. % |
| Sulfur | 0.0001 | to | 0.050 | Wt. % |
| Phosphorus | 0.0001 | to | 0.050 | Wt. % |
| Nitrogen | 0.10 | to | 0.30 | Wt. % |
| Iron | Balance | | | |

The composition is balanced such that:

$$3.50 \leqq \left(\frac{\text{Creq}}{\text{Nieq}}\right) \leqq 4.00$$

where:

Creq≡1.5(% Cr+% Si+% Mo)

Nieq≡% Ni+0.3(% Mn)+% Cu+22(% C)+5% N

A product of this material (cast or wrought) is then solution treated by heating to a temperature in the range of 2050° F.-2350° F., followed by rapid cooling (as with a water quench) to prevent formation of deleterious precipitates in the microstructure. For cast products, the specific composition and solution treatment temperature is selected so as to provide the desired combination of yield strength, impact toughness and corrosion resistance.

For cast material having a composition covered by this patent, it has been determined empirically that yield strength, composition and solution treatment temperature are related by the following approximate relationship:

$$Sy = 17.83\left(\frac{\text{Creq}}{\text{Nieq}}\right)^2 - 100.18\left(\frac{\text{Creq}}{\text{Nieq}}\right) + \left[\left(\frac{\text{Creq}}{\text{Nieq}}\right) - 3.05\right]^{0.7} + \left[\frac{T-2050}{1.85}\right]^{0.5} - 188.42$$

Where:

Sy=yield strength (0.2% offset) in KSI

Cr=chromium equivalent≡1.5(% Cr+% Si+% Mo)

Ni=nickel equivalent≡% Ni+0.3(% Mn)+% Cu+22(% C)+5(% N)

This relationship is presented graphically in FIG. 1. The experimental data from which this relationship was derived are shown in Table 1. This was done by the method of least squares polynomial regression curve fitting. A reference describing this is: Irwin Miller and John E. Freund, *Probability and Statistics for Engineers*, 2nd ed., Prentice Hall, 1977.

The relationship described above makes use of a ratio of ferrite forming elements (chromium equivalent) to austenite forming elements (nickel equivalent). It has been found that this ratio can also be used to insure that good impact toughness is maintained.

Figure 2:
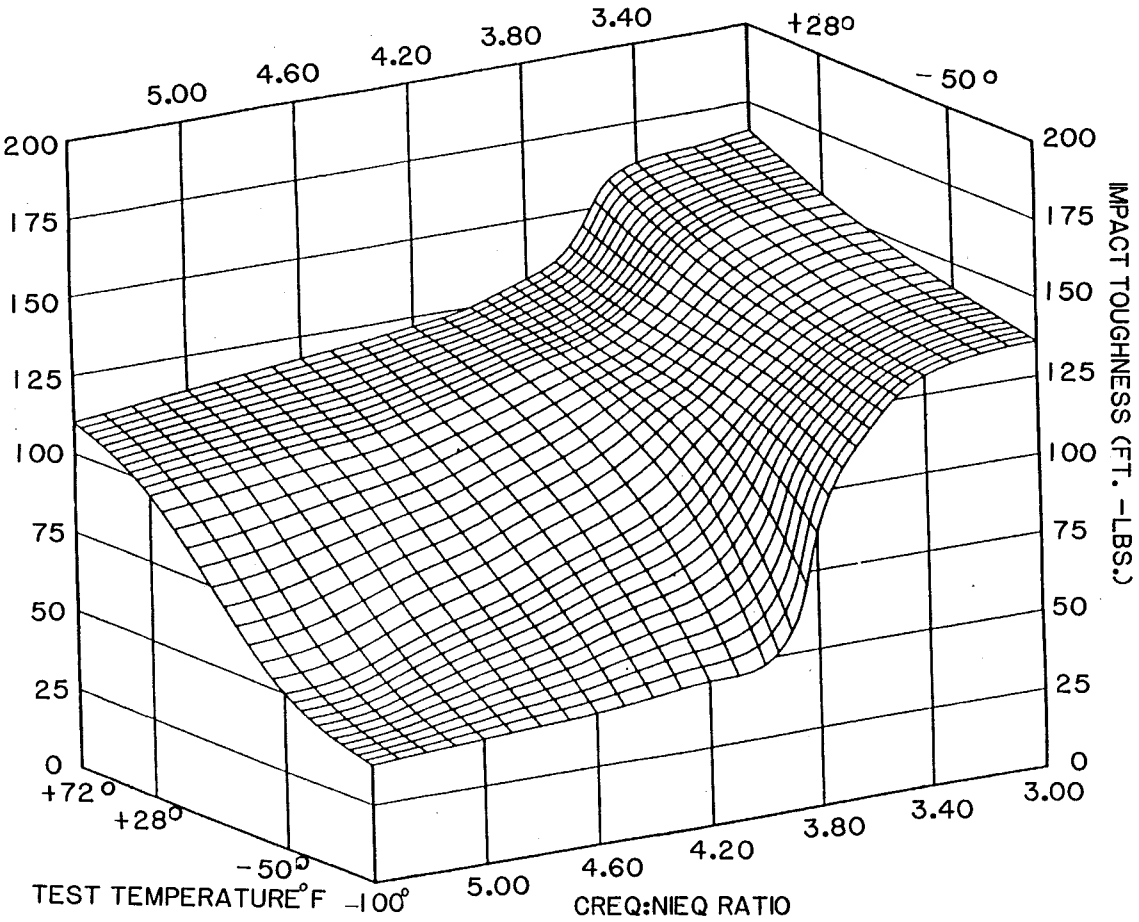

FIG. 2 shows a computer-drawn representation of the relationship between chromium equivalent: Nickel equivalent ratio, test temperature and impact toughness for cast material given a 2200° F. solution treatment. The experimental data used to develop this diagram are presented in Table II. Inspection of the diagram clearly shows that by maintaining low Creq:Nieq ratios, higher impact toughnesses can be realized.

The rationale for choosing the upper and lower Creq: Nieq ratio limits (3.50 and 4.00 respectively) can be understood by examining FIGS. 1 and 2. The lower limit was set at 3.50 since this appears to be the lowest value at which a yield strength of 65 KSI can be guaranteed in cast material given the range of solution treatment temperatures covered in this patent. For many applications where a duplex stainless steel such as this would be used, a minimum yield strength of 65 KSI is required. The upper limit was set at 4.00 since beyond this level, impact toughness values deteriorate markedly. Although the Creq and Nieq expressions of this patent were not specifically devised to describe other high strength duplex stainless steels, it should be pointed out that they are typically produced with much higher Creq:Nieq ratios than the inventive alloy. This would tend to place them in the lower toughness regions of the diagram in FIG. 2.

Mechanical properties of cast material from five heats of the inventive alloy are shown in Table III. Also shown are mechanical properties from one heat of forged material. The compositions of these heats may be found in Table I and in all cases, the solution treatment temperature was 2200° F. All five heats of the cast material as well as the wrought material show an excellent combination of strength and toughness. All testing was performed according to ASTM A 370-77.

Figure 3:
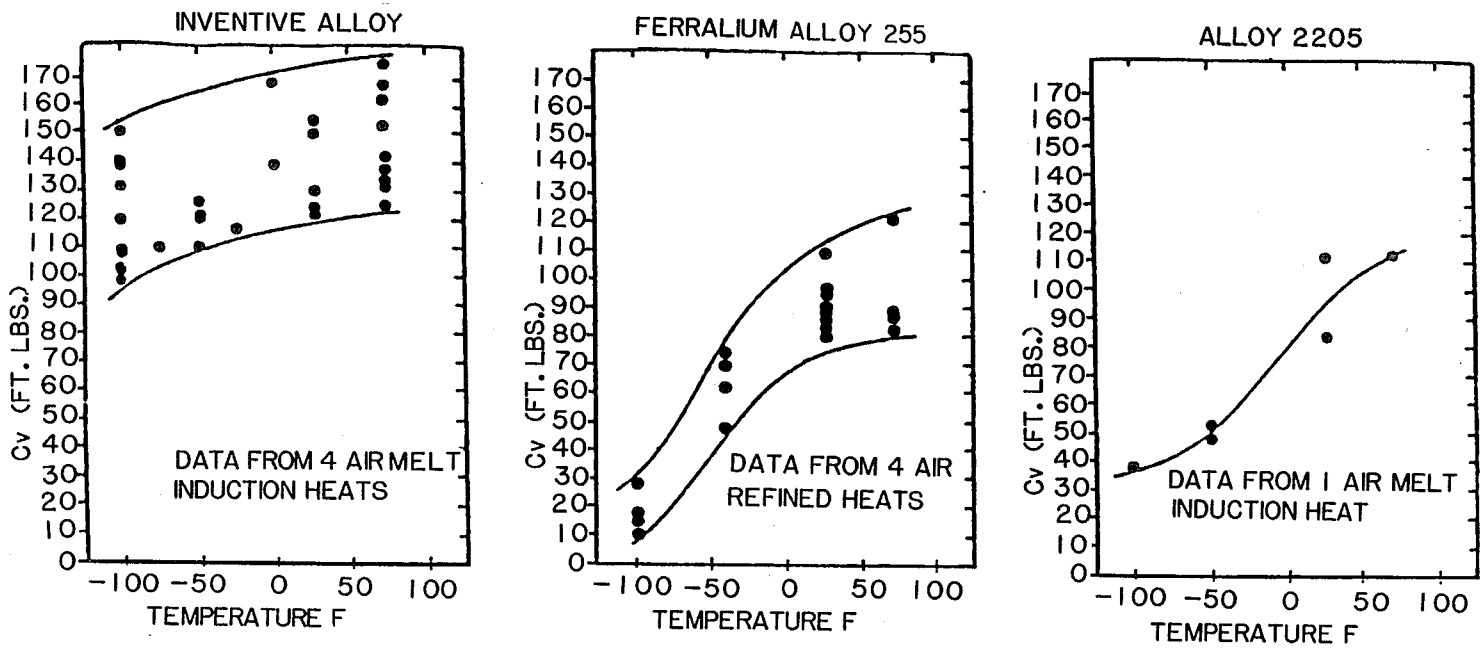

The superior impact toughness of cast material of the inventive alloy can be appreciated when it is compared to the toughness of other cast duplex stainless steels having similar strength. Two such materials are Alloy 2205 and Ferralium Alloy 255*. The impact toughness of these alloys and the inventive alloy are compared in FIG. 3. It can be easily seen that the inventive alloy possesses considerably greater impact toughness, particularly at low temperatures. At −100° F., the lowest impact toughness value of the inventive alloy was about 90 ft. lbs. The best value of the other two alloys at −100° F. was below 40 ft. lbs. A level of about 75 ft. lbs. is distinctly advantageus over high strength duplex stainless steels of the prior art. All of these data were obtained using standard charpy specimens taken from cast keel bars. The inventive alloy material was solution treated at 2200° F. while the other alloys were solution treated at their recommended temperature (2050° F.). All tests were performed in accordance with ASTM A370-77.

* Registered Trademark of Bonar-Langley Alloys Ltd., United Kingdom.

It should be pointed out that all of the impact toughness data presented for the inventive alloy were obtained from air-melt induction heats. Other melting processes which result in greater cleanliness (i.e., AOD or VOD refining) can be expected to result in even greater toughness values. For example, two recent AOD-refined heats of the inventive alloy had impact toughness values approximately 25% higher than air-melt induction heats of similar Creq:Nieq ratio.

The inventive alloy also shows superior weldability. while high strength duplex stainless steels of the prior art are known to suffer severe embrittlement in the HAZs of welds, this invention produces material which is far more resistant to the problem. In order to illustrate this, test welds were made in cast material from four heats of the inventive alloy, four heats of Ferralium Alloy 255 and one heat of Alloy 2205. Prior to welding, the inventive alloy material had been solution treated at 2200° F., while the other materials had been solution treated at 2050° F. The welding procedure employed was as follows:

Process—SMAW
Filler Material—Sandvik 22.9.3 (4 mm Dia.)
Preheat—None
Current—135 AMPS
Polarity—DCRP
Interpass Temp—200° F. MAX
Post Weld Heat Treatment—None After welding, standard charpy impact specimens were removed from the welded plates such that the specimen notches were located in the HAZs of the welds. The specimens were then tested according to ASTM A370-77.

Figure 4:
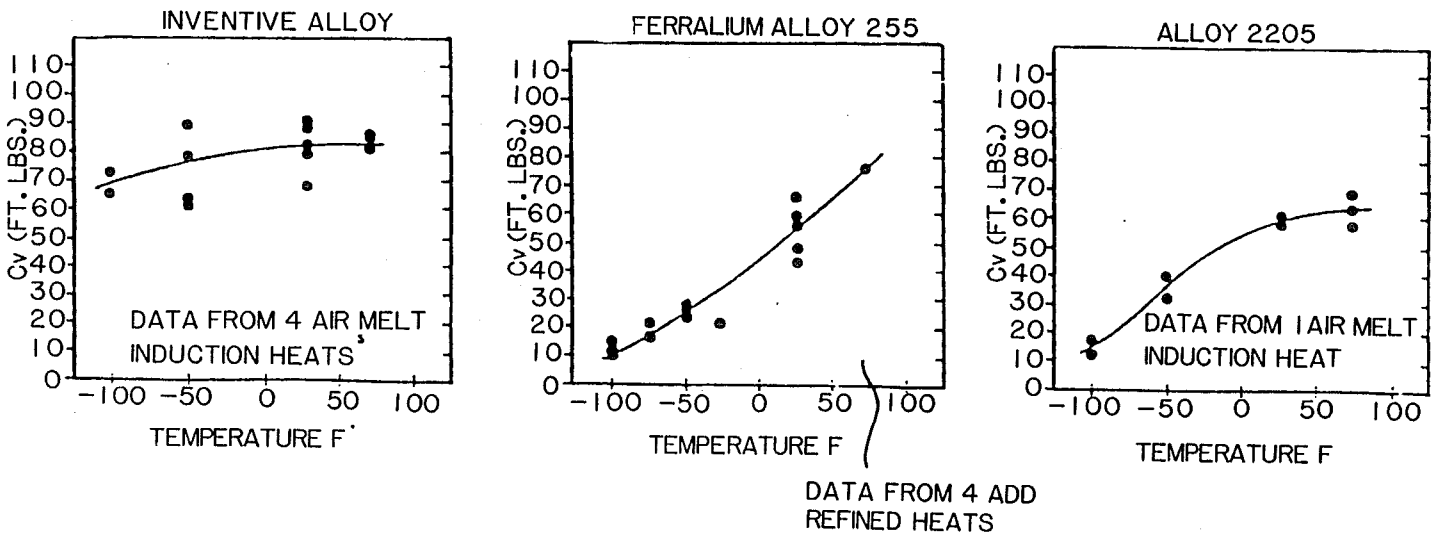

The HAZ impact toughness results are presented in graphical form in FIG. 4. While the inventive material did show some loss of toughness (see Table II), the HAZs of the other alloys were seriously degraded in toughness. The inventive alloy had HAZ impact toughness values above 50 ft. lbs. At −100° F. while the other two alloys gave values less than 20 ft. lbs. at the same temperatures.

Figure 5:
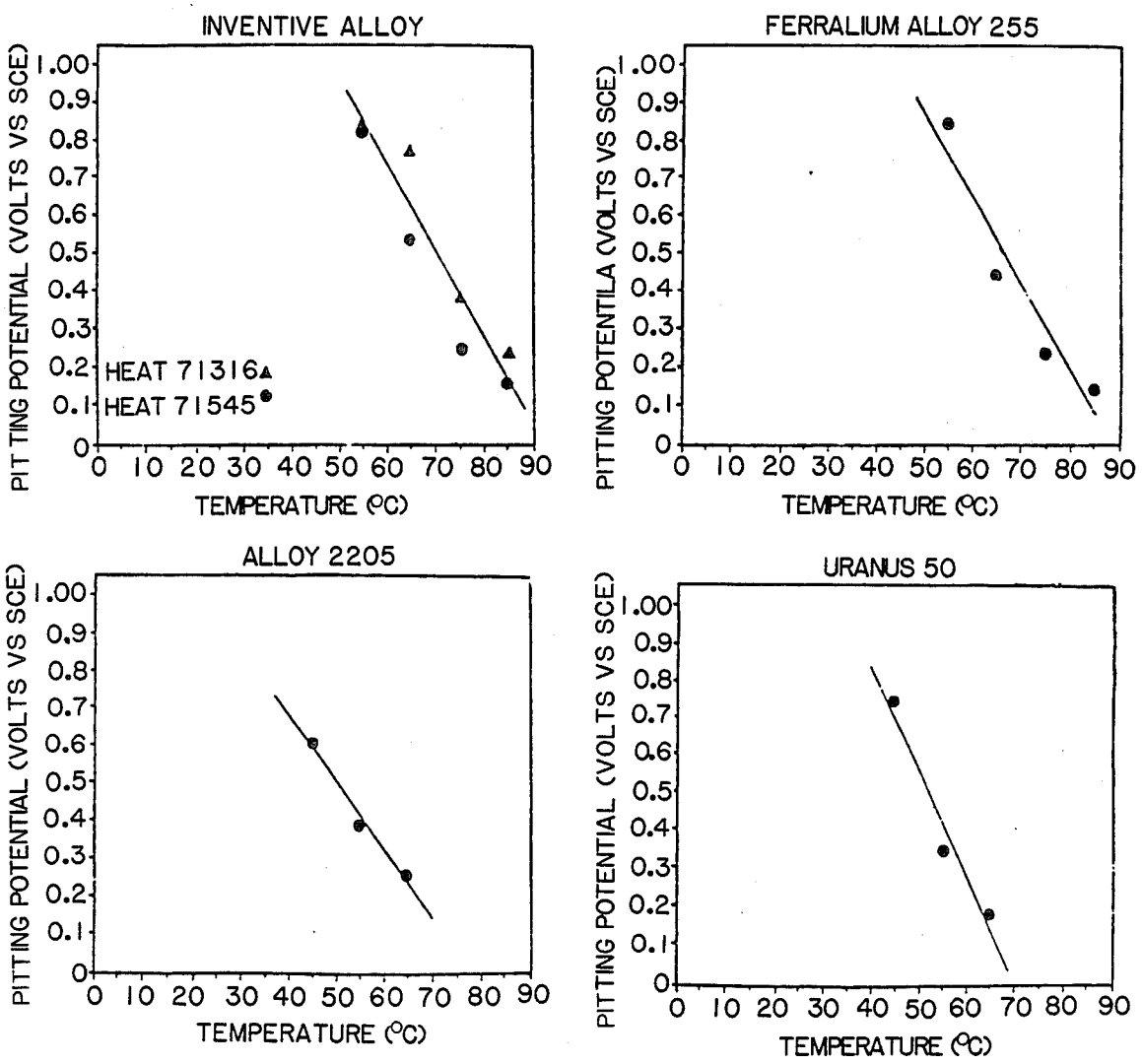

In many environments, the corrosion resistance of the inventive alloy is similar to that of high strength duplex stainless steels of the prior art. For chloride-containing environments, this has been established electrochemically. Specimens of the inventive alloy and other duplex stainless steels have been subjected to rapid scan potentiodynamic tests in a deaerated solution of water plus 5% sodium chloride plus 0.01M hydrochloric acid. The results of this comparison testing are presented in graph form in FIG. 5. Clearly, the test results of the inventive alloy are at least as good as those of any of the other alloys examined. It is appreciated that electrochemical corrosion resistance data are highly dependent upon technique and the specific test method. However, the tests performed were consistent so as to obtain data that were as comparable as possible.

Compared to other cast high strength duplex stainless steels, the material of this invention has superior resistance to cracking in sour ($H_2S$-bearing) environments. In evaluating materials for service in sour environments, it is common to employ tests conducted according to NACE Standard TM-01-77. This test involves stressing tensile specimens of the material being studied in a solution simulating conditions in sour oil wells. The solution consists of water, sodium chloride and acetic acid through which hydrogen sulfide and carbon dioxide gases are bubbled. Specimens are stressed to various percentages of their yield strengths in order to determine the highest stress level at which fracture does not occur. The higher this stress level, the better the material's cracking resistance.

Specimens from three heats of the inventive alloy (71545, 72497 and 72847) have been tested. These have survived 720 hours (the duration of the standard test) unbroken at stress levels up to and including 80% of their yield strengths. In addition, specimens containing welds in their gage lengths (both as welded and resolution treated) have passed the test at 80% of the base metal's yield strength. As far as is known, no other cast duplex stainless steels of similar strength level have been able to perform this well.

Depending upon the characteristics desired, certain narrower preferred ranges of alloying elements can be utilized. These are shown in Table IV. For example, when superior corrosion resistance in chloride-containing environments is desired, composition "C" is advantageously employed. If maximum toughness is desired, composition "A" is preferred. Composition "A" is also preferred for thick-section parts since it is more resistant to formation of deleterious precipitates. Composition "B" offers a combination of improved corrosion resistance compared to Composition "A", but with improved toughness with respect to Composition "C". For further clarification, consider the following examples:

EXAMPLE 1

Suppose it was desired to produce a small valve body having good-to-excellent corrosion resistance in the presence of chlorides, a minimum yield strength of 65 KSI and a minimum impact toughness of 75 ft-lbs at −100° F. Since the size of the casting is small and the degree of corrosion resistance must be high, composition "C" would be selected. A heat of the inventive alloy would be produced having a composition falling within the limits of "C". An example of such a heat is Heat 72497, which had the following actual composition:

| | |
|---|---|
| C | 0.039% |
| Mn | 0.54 |
| Si | 1.05 |
| Cr | 24.59 |
| Ni | 9.83 |
| Mo | 3.51 |
| Cu | 0.11 |
| N | 0.198 |
| Fe | Balance |

The Creq:Nieq ratio would then be calculated. For Heat 72497, this was 3.66. A solution treatment temperature would then be chosen so as to obtain the desired yield strength. For Heat 72497, an appropriate temperature would be 2200° F. When material from Heat 72484 was solution treated at 2200° F., the resulting yield strength was 67.9 KSI. The resulting average impact toughness at −100° F. was 100 ft-lbs. These values would readily satisfy the requirements listed above.

EXAMPLE 2

Suppose it was desired to produce a large pump casting requiring excellent toughness in relatively heavy sections. A yield strength of 70 KSI minimum and moderate corrosion resistance in the presence of chlorides. Since thick sections are involved and extreme corrosion resistance is not required, composition "A" would be selected. As in the previous example, a heat of the inventive alloy would be produced and solution treated at a temperature selected to give the desired yield strength level.

Experimental Heat 70335 had a composition which would be acceptable for this application:

| | |
|---|---|
| C | 0.052% |
| Mn | 0.44 |
| Si | 1.20 |
| Cr | 20.88 |
| Ni | 9.05 |
| Mo | 3.83 |
| Cu | 0.18 |
| N | 0.13 |
| Fe | Balance |

For this compositon, FIG. 2 indicates that a solution treatment temperature of 2200° F. should be adequate to obtain a yield strength level of 70 KSI. When material from Heat 70335 was solution treated at 2200° F., the resulting yield strength was 70.5 KSI. The impact toughness at −100° F. averaged 138 ft-lbs. As in the previous example, these properties would meet the required values.

While in the foregoing specification a detailed description of the invention has been set down, many variations in the details hereingiven may be made by those skilled in the art without departing from the spirit and scope of the invention.

I claim:

1. A duplex stainless steel having austenite pools in a ferrite matrix resulting from heating to a temperature in the range of 2050° F.–2350° F. and cooling rapidly thereafter, said steel consisting essentially of except for residual elements:

| | | | | |
|---|---|---|---|---|
| Carbon | 0.001 | to | 0.08 | Wt. % |
| Manganese | 0.001 | to | 2.00 | Wt. % |
| Silicon | 0.001 | to | 1.50 | Wt. % |
| Chromium | 20.00 | to | 27.50 | Wt. % |
| Nickel | 8.00 | to | 11.00 | Wt. % |
| Molybdenum | 3.00 | to | 4.50 | Wt. % |
| Sulfur | 0.0001 | to | 0.050 | Wt. % |
| Phosphorus | 0.0001 | to | 0.050 | Wt. % |
| Nitrogen | 0.10 | to | 0.30 | Wt. % |
| Iron | Balance | | | |

such that:

$$3.50 \leqq \left(\frac{\text{Creq}}{\text{Nieq}}\right) \leqq 4.00$$

where:

Creq≡1.5(% Cr+% Si+% Mo)

Nieq≡% Ni+0.3(% Mn)+% Cu+22(% C)+5% N and having greater impact toughness values in the cast form than Ferralium Alloy 255 and SAF 2205, the impact toughness in Charpy V-notch testing at −100° F. being above about 75 ft-lbs. when tested from keel blocks per ASTM E23-82, the HAZ impact toughness at −100° F. being above about 50 ft-lbs. and having a yield strength of at least 65 KSI.

* * * * *